United States Patent [19]

Yates

[11] Patent Number: 4,853,991

[45] Date of Patent: Aug. 8, 1989

[54] BEDDING FOUNDATION HAVING MULTIPLE-SPAN SINUOUS WIRE SPRINGS

[75] Inventor: Chester R. Yates, Carthage, Mo.

[73] Assignee: Leggett & Platt, Incorporated, Carthage, Mo.

[21] Appl. No.: 166,117

[22] Filed: Mar. 10, 1988

[51] Int. Cl.[4] ..... A47C 23/04

[52] U.S. Cl. ..... 5/247; 5/255; 5/268; 267/103

[58] Field of Search ..... 5/247, 255, 268, 476; 267/80, 86, 95, 100, 103–109

[56] References Cited

U.S. PATENT DOCUMENTS

| | | | |
|---|---|---|---|
| 2,105,115 | 1/1938 | Gleason . | |
| 2,798,233 | 7/1957 | Robell . | |
| 2,826,768 | 3/1958 | Drews . | |
| 2,979,739 | 4/1961 | Krakauer . | |
| 3,803,689 | 4/1974 | Baginski | 267/103 X |
| 3,825,960 | 7/1974 | Inman et al. . | |
| 3,833,948 | 9/1974 | Surletta et al. . | |
| 3,835,485 | 9/1974 | Klicki . | |
| 3,860,227 | 1/1925 | Hughes | 267/103 |
| 3,990,121 | 11/1976 | Whitaker . | |
| 4,012,801 | 3/1977 | King et al. | 5/247 |
| 4,100,631 | 7/1978 | Slone . | |
| 4,770,397 | 9/1988 | Schulz, Jr. | 5/247 X |

*Primary Examiner*—Gary L. Smith
*Assistant Examiner*—Michael F. Trettel
*Attorney, Agent, or Firm*—Wood, Herron & Evans

[57] ABSTRACT

A box spring assembly includes a base frame, a top wire grid and a plurality of sinuous wire spring strips interconnecting the top wire grid and the base frame. The sinuous wire spring strips each comprises six substantially vertical legs and three spaced, substantially flat, horizontal platform sections with the flat platform sections of each spring being attached to the top wire grid and the bottom ends of each leg being attached to the base frame.

14 Claims, 2 Drawing Sheets

BEDDING FOUNDATION HAVING MULTIPLE-SPAN SINUOUS WIRE SPRINGS

This invention relates to bedding foundations, and more particularly, to a box spring style of bedding foundation.

Prior art box springs or bedding foundations have generally included coil springs positioned in a vertical orientation so as to provide resilient support for a bedding mattress. In an effort to improve upon these prior art coil spring types of box spring or bedding foundations, numerous prior art box spring assemblies have been developed which substitute formed wire springs for the more traditional coil springs. "Formed wire" springs is an art term used to describe springs which derive their resiliency from torsion bars rather than coils. Examples of formed wire springs embodied in box spring assemblies are to be found in U.S. Pat. Nos. 3,825,960; 3,833,948; and 3,835,485. Additionally, some prior art box springs have been developed which include combinations of coil and formed wire springs, as for example, the box spring assembly shown in U.S. Pat. No. 3,990,121. In those instances wherein formed wire springs and coil springs have been combined in a box spring, the formed wire springs have usually functioned to impart additional firmness to selected areas of the box spring, as for example, around the edge of the box spring or in the center section of the box spring.

A common problem with all box springs which utilize formed wire springs is that those box springs are relatively expensive to manufacture, primarily because the equipment upon which the formed wire spring portions of the box spring are manufactured are usually capable of making only one bend per stroke of a forming machine. Consequently, the formed wire springs, which generally have multiple bends formed therein, are expensive to produce, and the resulting box spring includes an expensive configuration of multiple formed wire springs.

It has therefore been an objective of this invention to provide an improved box spring which utilizes a novel formed wire spring to provide resilient support of the load supporting surface of the box spring, but which formed wire spring is relatively inexpensive to manufacture.

Still another objective of this invention has been to provide an improved box spring which has all of the resiliency and selective firmness characteristics of prior art box springs, but which may be manufactured and sold substantially less expensively.

The present invention is directed toward an improved and relatively firm box spring. The firmness of the unit is imparted by a novel formed wire spring having multiple torsion bar sections formed therein. This novel torsion bar containing formed wire spring, though, is one which is much less expensively produced and manufactured than prior art torsion bar formed springs which have heretofore characterized the prior art.

The formed wire springs manufactured in accordance with the practice of this invention are formed from conventional sinuous wire strips of the type having oppositely facing edge loops interconnected by straight torsion bar sections. According to the practice of this invention, each of these strips is bent into multiple, substantially vertical legs supporting spaced, flat, horizontal platform sections. The lower ends of the vertical legs of the sinuous spring strips are, according to the practice of this invention, attached to the base frame, and the flat top platform sections of the strip are connected to the wire grid of the box spring assembly. Thus, the sinuous wire springs provide a resilient support for the load bearing top wire grid of the box spring.

According to the practice of this invention, these sinuous wire springs are so configured and are so positioned within the spring assembly so as to generate the desired firmness at selected locations within the assembly.

Sinuous wire spring strips have in the past been utilized to provide edge support for a mattress or box spring. Examples of such edge supported sinuous wire springs may be found in U.S. Pat. Nos. 2,105,115; 2,826,768; and 2,798,233. Sinuous springs have also been used to provide support between spaced decks of a bedding product, such as the products disclosed in U.S. Pat. Nos. 2,979,739 and 4,100,631. Except as disclosed in co-pending application Ser. Nos. 030,461, now U.S. Pat. No. 4,730,359, 038,503, now U.S. Pat. No. 4,760,616 and 144,819, all of which are assigned to the assignee of this application, sinuous wire spring strips have never, to our knowledge, been formed into wire springs for providing the resilient support between a top wire grid and a bottom frame of a box spring.

In the above-identified pending applications, there are disclosed generally U-shaped, sinuous wire springs used in a bedding box spring, but as disclosed in those applications, the closed end of the U-shaped spring is either attached to the base frame of the box spring and the open end is attached to the wire grid, or vice versa. These earlier constructions required the handling and placement of numerous individual sinuous wire springs. The spring unit of this application, on the other hand, while manufactured from sinuous wire spring strips, substantially reduces the cost of the resulting box spring product by reducing the number of individual springs employed in the product and the resulting manufacturing and handling costs.

These and other objects and advantages of the present invention will be more readily apparent from the following description of the drawings, in which.

Figure 1:
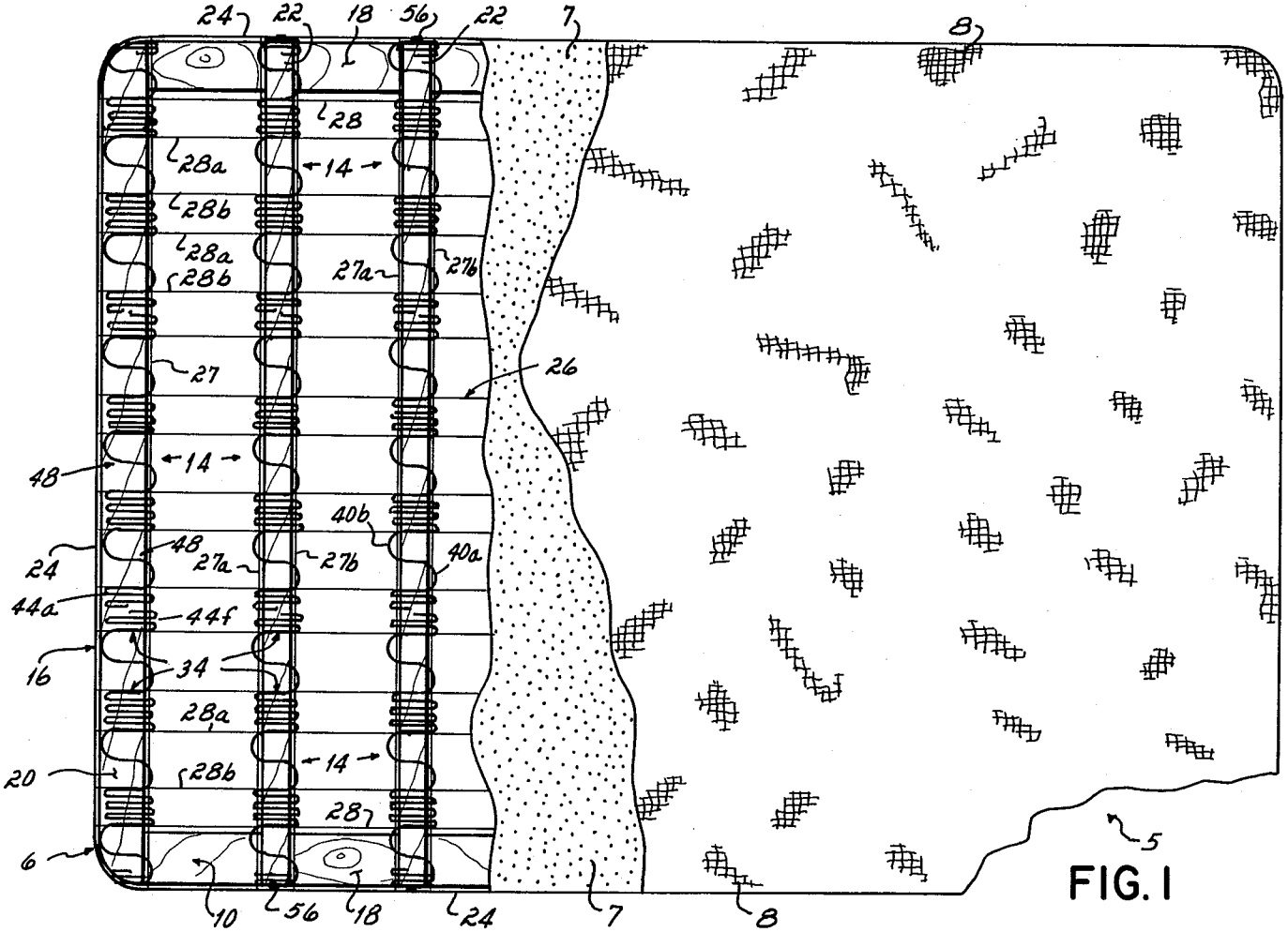
FIG. 1 is a top plan view, partially broken away, of a box spring incorporating the invention of this application.

With reference first to FIG. 1, it will be seen that the bedding foundation or box spring 5 of this invention includes a box spring assembly 6 over the top of which padding 7 is placed. The box spring assembly 6 and the padding are encased in an upholstered covering 8.

The box spring assembly 6 comprises a wooden base frame 10 upon the top of which there is mounted a plurality of sinuous wire springs 14 for supporting a top wire grid 16. The top wire grid is intended to resiliently support a mattress as is conventional in the bedding industry.

The base frame 10 is rectangular in configuration and comprises a pair of longitudinally extending side boards 18, as well as a pair of transversely extending end boards 20 nailed or otherwise secured to the top of the side boards 18. Additionally, there are a plurality of wooden slats 22 which extend transversely across the rectangular base between the side boards 18. These slats are also nailed or otherwise fixedly secured to the top of the side boards 18.

The top wire grid 16 comprises a border wire 24 and a welded wire grid 26. The border wire 24 is formed into a rectangular configuration and overlies the peripheral edge of the rectangular base frame 10. The welded wire grid 26 is secured to and located in the plane of the border wire 24, the grid and border wire defining the top plane of the box spring assembly 6. The welded wire grid 26 comprises a plurality of spaced, transverse wires 27 and a plurality of spaced, longitudinal wires 28. All but the endmost ones of the transverse wires 27 are arranged in pairs **27*a*, 27*b*, and all of the longitudinal wires 28 are arranged in pairs 28*a*, 28*b*. All of the wires 27 and 28 of the welded wire grid 26 extend between opposite sides and ends, respectively, of the rectangular border wire 24. These grid wires overly the sinuous wire springs 14 and are secured to the tops of these springs 14**, as explained more fully hereinafter.

The ends of all the grid wires 27 and 28 are hooked around the border wire 24 and are preferably welded to the border wire. The intersections or crossover points of the transverse wires 27 and the longitudinal wires 28 are welded together, thereby providing an integral welded wire top grid. In manufacture, the border wire 24 and the welded wire grid are all preformed into a welded top wire grid subassembly 16.

The top wire grid subassembly 16 is supported upon the top of the sinuous wire springs 14, and the sinuous wire springs are in turn supported upon the top of the wooden base frame 10. With particular reference to FIGS. 2–5, it will be seen that each of these sinuous wire springs 14 comprises a sinuous wire spring strip made from wire bent back and forth upon itself into a conventional sinuous form so as to have oppositely facing edge loops 40 interconnected by straight torsion bars 42. According to the practice of this invention, each of these sinuous spring strips is configured or formed into three spaced, flat, top sections 48 and six vertical legs 44. Each top section 48 is generally S-shaped and comprises three parallel torsion bars **42*a*, 42*b*, 42*c* interconnected by two oppositely facing edge loops 40*a* and 40*b*. Each vertical leg 44 comprises three edge loops 40*c*, 40*d*, and 40*e* interconnected by a pair of parallel torsion bars 42*d* and 42*e*. Additionally, there is a bottom torsion bar 42*f* connected to the lowermost edge loop 40*e* of each leg 44. This bottom torsion bar 42*f* is stapled to an end board 20 or a transverse slat 22 of the base frame 10, as explained more fully hereinafter. The topmost edge loop 40*c* of each vertical leg is connected to an end torsion bar 42*a* or 42*c* of a top section 48**.

Figures 2, 3, 4, 5, 6:
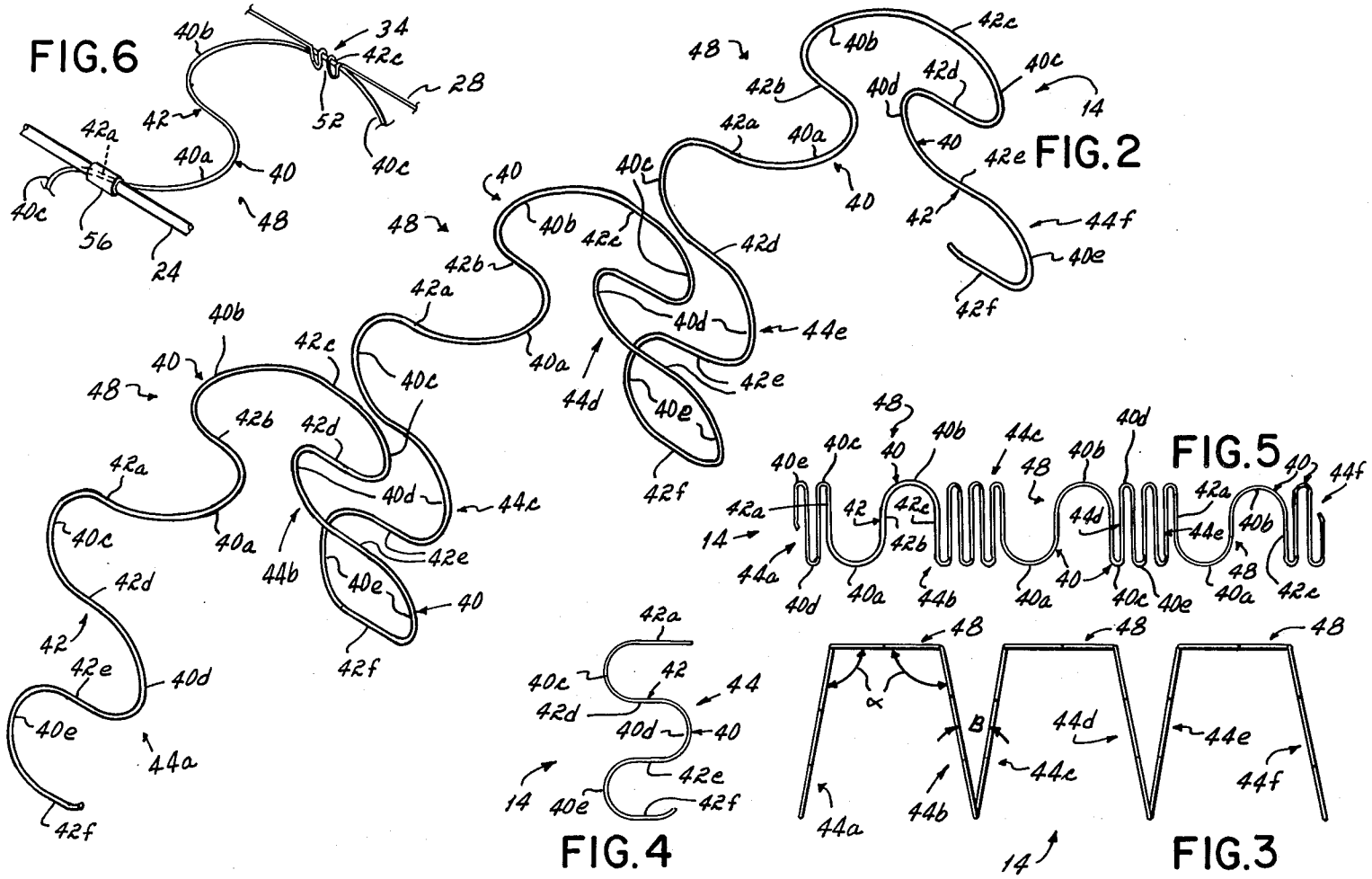
FIG. 2 is a perspective view of one sinuous wire spring employed in the box spring of FIG. 1.
FIG. 3 is a side elevational view, on a reduced scale, of the, sinuous wire spring of FIG. 2.
FIG. 4 is an end elevational view, on a reduced scale, of the sinuous wire spring of FIG. 2.
FIG. 5 is a top plan view, on a reduced scale, of the sinuous wire spring of FIG. 2.
FIG. 6 is an exploded perspective view of a portion of one sinuous wire spring illustrating the manner in which it is attached to a border wire and a grid wire of the box spring of FIG. 1.

With reference to FIGS. 2 and 3, it will be seen that the endmost vertical legs **44*a* and 44*f* terminate in a torsion bar 42*f* which forms one end of a sinuous spring strip from which the sinuous wire spring 14 is formed. The intermediate vertical legs, on the other hand, are arranged in generally V-shaped pairs with each pair sharing or having a common lower torsion bar 42*f***.

With particular reference to FIG. 3, it will be noted that the vertical legs 44 are not actually located in vertical planes, but rather extend generally at a slight angle to a vertical plane. In the preferred practice of this invention, the angle $\alpha$ between each vertical leg and the flat top section to which it is connected is approximately 101 degrees. The angle B between adjacent interconnected vertical legs is approximately 22 degrees. Consequently, adjacent vertical legs are arranged in pairs which define between them an included angle of approximately 22 degrees.

In the preferred practice of this invention, the edge loops of the flat top sections 48 and the vertical legs 44 are all of the same radius, approximately 2.4 cm in radius, and the torsion bars are all approximately 2.2 cm in length. In this preferred practice of the invention, the flat top sections 48 are approximately 9.6 cm in width, and the bottom torsion bars **42*f* are spaced approximately 15 cm apart, except for the endmost torsion bars in each transverse row which are spaced approximately 10 cm from the adjacent bottom torsion bar. The sinuous springs 14** are all approximately 14 cm in height.

In the illustrated embodiment there are nine transverse rows of sinuous wire springs 14 extending transversely across the width of the box spring 5. Each transverse row comprises three sinuous wire springs 14 connected in end-to-end relationship with the adjacent ends of adjacent springs 14 stapled to common transverse slats or end boards of the base frame 10.

In order to connect the flat top sections of the sinuous wire springs 14 to the top wire grid 16 (FIGS. 1 and 6), the endmost torsion bars **42*a* or 42*c* of each row of sinuous wire springs are located parallel to and adjacent the border wire 24. These endmost torsion bars are connected to the border wire by conventional sheet metal clips 56. Intermediate those endmost torsion bars 42*a*, 42*c* of each row of sinuous wire springs 14 the endmost torsion bars 42*a*, 42*c* of each flat top section 48 of a row of sinuous wire springs underly one of the longitudinal wires 28 of the grid and are received within U-shaped recesses 52 of hooks 34 formed in these longitudinal wires 28. The hooks 34 are conventional, double, reversely bent hooks preformed into the longitudinal wires of the welded wire grid. Each hook 34 is formed as an open U-shaped element which opens downwardly so that the grid may be placed over the torsion bars 42*a*, 42*c*** *of* the flat top sections 48 of the sinuous wire springs. With the torsion bars **42*a*, 42*c* of the flat top sections located within the downwardly facing, U-shaped hooks, the hooks are bent or crimped to a closed condition so as to lock the torsion bars 42*a*, 42*c* of the flat top sections 48 within the hooks, and thereby lock the flat top sections of the sinuous wire springs to the top wire grid 16. The hooks 34** in the longitudinal wires are conventional and therefore have not been described in detail herein. A complete description of these hooks and the manner in which they are formed may be found in Ciampa U.S. Pat. No. 3,577,574.

It is to be noted that the illustrated embodiment of this invention utilizes three individual sinuous wire springs in each transverse row of springs of the box spring 5, and in this illustrated, preferred embodiment each sinuous wire spring 14 comprises three flat top sections 48 and six substantially vertical legs 44 (identified individually as **44*a*–44*f*). Depending upon the width of the box spring, there may be greater or lesser numbers of flat top sections 48 in each sinuous wire spring 14, or there may be greater or lesser numbers of sinuous wire springs 14** in each transverse row of springs.

In practice, the box spring 5 of FIG. 1 is assembled by first nailing the end boards 20 to the tops of the side boards 18 and by nailing the slats 22 to the tops of these same side boards. The bottom torsion bars 42*f* of the sinuous wire springs 14 are then stapled to the tops of the end boards 20 and the slats 22. The preassembled top wire grid 16 is then fitted over the top of assembled wooden frame and springs 14 so as to position the endmost torsion bars 42*a*, 42*c* of the flat top sections 48 within the U-shaped recesses 52 of the hooks 34 in the longitudinal wires 28 of the grid. The hooks are then crimped shut so as to secure the wire grid to the sinuous wire springs 14. The border wire 24 is then connected by sheet metal clips 56 to the endmost torsion bars 42*a* or 42*c* of each row of sinuous wire springs 14. To complete the box spring assembly, a conventional padding 7 of fabric pad or other suitable material is overlaid over the top of the welded wire grid, and the complete assembly, including the rectangular wooden frame, the springs, the top wire grid, and the padding, are enclosed within the upholstery covering 8.

While I have described only one preferred embodiment of my invention, persons skilled in this art will appreciate changes and modifications which may be made without departing from the spirit of my invention. Therefore, I do not intend to be limited except by the scope of the following appended claims.

I claim:

1. A bedding foundation comprising, a bottom, substantially rectangular, base frame having side and end members and slats extending between said side members, a substantially planar, rectangular top wire grid, said grid comprising a border wire and first and second sets of wires, said border wire being of rectangular configuration and surrounding said first and second sets of wires, said first set of wires comprising a plurality of longitudinally extending, spaced, parallel wires and said second set of wires comprising a plurality of transversely extending, spaced parallel wires, said first and second sets of wires intersecting one another and being fixedly connected to said border wires, a plurality of sinuous wire springs interconnecting said base frame and said wire grid, said sinuous wire springs each comprising a sinuous spring strip made from wire bent back and forth to have oppositely facing edge loops interconnected by straight torsion bar section, each of said strips being formed into a plurality of at least four substantially vertical legs and at least two substantially flat, horizontal platform sections, said flat platform sections of each of said sinuous wire springs being secured to said wire grid and the ends of said vertical legs of each of said sinuous springs remote from said flat platform sections being secured to said base frame, each of said vertical legs of each of said sinuous wire springs consisting of three edge loops interconnected by a pair of straight torsion bars, the lowermost one of the edge loops being connected to a bottom straight torsion bar, the lowermost edge loops of at least two of said vertical legs being connected to a common bottom torsion bar, and said flat platform sections of each of said sinuous wire springs consisting of a pair of edge loops and three straight torsion bars, a fabric pad overlying said top wire grid, and an upholstered covering surrounding said base frame, top wire grid, sinuous wire springs, and said fabric pad.

2. A bedding foundation assembly comprising, a bottom, substantially rectangular, base frame having side and end members, a substantially planar rectangular top wire grid, said grid comprising a border wire and first and second sets of wires, said first set of wires comprising a plurality of longitudinally extending, spaced, parallel wires, said second set of wires comprising a plurality of transversely extending, spaced, parallel wires, the ends of both said first and second sets of wires fixedly connected to said border wire, a plurality of sinuous wire springs interconnecting said base frame and said wire grid, said sinuous wire springs each comprising a sinuous spring strip made from wire bent back and forth upon itself to form oppositely facing edge loops interconnected by straight torsion bar sections, said spring strip being formed into a plurality of at least four substantially vertical legs and at least two substantially flat horizontal platform sections, said flat horizontal platform sections of each of said sinuous wire springs being secured to said wire grid and the ends of said vertical legs of each of said sinuous springs remote from said flat platform sections being fixedly secured to said base frame, and each of said substantially vertical legs of each of said sinuous wire springs consisting of three edge loops interconnected by a pair of straight torsion bars, the one of the edge loops most remote from the flat platform sections being connected to a bottom straight torsion bar, said most remote loops from the flat platform sections of at least two of said vertical legs being connected to a common torsion bar, and said flat platform sections of each of said sinuous wire springs consisting of a pair of edge loops and three straight torsion bars.

3. The bedding foundation assembly of claim 2 wherein said edge loops are all of substantially the same radius.

4. A bedding foundation assembly comprising, a bottom, substantially rectangular, base frame having side and end members, radiused corners, and slats extending between said side members, a substantially planar rectangular top wire grid, said grid comprising a border wire and first and second sets of wires, said border wire being of rectangular configuration and surrounding said first and second sets of wires, said border wire having radiused corners, said first set of wires comprising a plurality of longitudinally extending, spaced, parallel wires and said second set of wires comprising a plurality of transversely extending, spaced, parallel wires, said first and second sets of wires being fixedly connected to said border wire, a plurality of sinuous wire springs interconnecting said base frame and said wire grid, said sinuous wire springs each comprising a sinuous strip made from wire bent back and forth to have oppositely facing loops interconnected by straight torsion bar sections, each of said strips being formed into a plurality of at least four substantially vertical legs and at least two substantially flat, horizontal platform sections, said flat platform section of each of said sinuous wire springs being secured to said top wire grid and the ends of said vertical legs remote from said flat platform sections of each of said sinuous springs being fixedly secured to said base frame, each of said substantially vertical legs of each of said sinuous wire springs comprising at least three edge loops interconnected by straight torsion bars, the bottom endmost one of the edge loops most remote from said flat platform section being connected to a bottom torsion bar, and said bottom endmost edge loops of at least two of said vertical legs being connected to a common bottom torsion bar.

5. The assembly of claim 4 in which each of said flat platform sections of each of said sinuous wire springs consists of a pair of edge loops and three torsion bars, one of said three torsion bars being connected at its opposite ends to said pair of edge loops, and the other two of said three torsion bars being connected to two parallel wires of one of said first and second sets of said top wire grid.

6. The assembly of claim 4 in which each of said strips is formed into six substantially vertical legs and three flat, horizontal platform sections.

7. The assembly of claim 6 in which each of said strips comprises two endmost, substantially vertical legs and two pair of intermediate vertical legs, and each pair of intermediate vertical legs terminating in a common bottom straight torsion bar section of said strip.

8. A sinuous wire spring for use in interconnecting a base frame and a wire grid of a bedding foundation, said sinuous wire spring comprising a sinuous spring strip made from wire bent back and forth to have oppositely facing edge loops interconnected by straight torsion bar sections, said strip being formed into a plurality of at least four substantially vertical legs and at least two substantially flat, horizontal platform sections, each of said flat platform sections of said sinuous wire spring being adapted to be secured to said top wire grid, the ends of said vertical legs remote from said flat platform sections of said sinuous spring being adapted to be fixedly secured to said base frame, each of said substantially vertical legs of said sinuous wire spring comprising three edge loops and three torsion bars, the lowermost one of said torsion bars of said vertical legs being adapted to be connected to said base, and the bottom edge loop of at least two of said vertical legs being connected to a common lowermost torsion bar.

9. The sinuous wire spring of claim 8 in which each of said flat platform sections comprises a pair of oppositely facing edge loops and three torsion bars, one of said three torsion bars being connected at its opposite ends to said pair of edge loops, and the other two of said three torsion bars being adapted to be connected to two parallel wires of a wire grid.

10. The sinuous wire spring of claim 8 in which said strip is formed into six substantially vertical legs and three spaced, flat, horizontal platform sections.

11. The sinuous wire spring of claim 10 in which said strip comprises two endmost, substantially vertical legs and two pair of intermediate vertical legs, and each pair of intermediate vertical legs terminating in a common bottom straight torsion bar of said strip.

12. A sinuous wire spring for use in a bedding foundation, said sinuous wire spring comprising a sinuous spring strip made from wire bent back and forth to have oppositely facing edge loops interconnected by straight torsion bar sections, said strip being formed into a plurality of at least four substantially vertical legs and at least two spaced, substantially flat, horizontal platform sections, each of said flat platform sections of said sinuous wire spring comprising a pair of oppositely facing edge loops and three torsion bars, one of said three torsion bars, being connected at its opposite ends to said pair of edge loops, and the other two of said three torsion bars each being connected to one of said substantially vertical legs, each of said substantially vertical legs of said sinuous wire spring comprising three loops and three torsion bars, and a bottom edge loop of at least two of said substantially vertical legs being connected to a common lowermost torsion bar.

13. The sinuous wire spring of claim 12 in which said strip is formed into six substantially vertical legs and three spaced, flat, horizontal platform sections.

14. The sinuous wire spring of claim 13 in which said six substantially vertical legs comprises two endmost, substantially vertical legs and two pair of intermediate, substantially vertical legs, and each pair of intermediate substantially vertical legs forming a V strip and terminating in a common bottom straight torsion bar.

* * * * *

UNITED STATES PATENT AND TRADEMARK OFFICE

CERTIFICATE OF CORRECTION

PATENT NO. : 4,853,991

DATED : August 8, 1989

INVENTOR(S) : Chester R. Yates

It is certified that error appears in the above-identified patent and that said Letters Patent is hereby corrected as shown below:

Column 3, line 26, "overly" should be -- overlie -- .

Column 4, line 39, "underly" should be -- underlie --.

Column 6, line 37, after "remote", insert -- edge -- .

Column 6, line 63, after "sinuous", insert -- spring -- .

Column 6, line 65, after "facing", insert -- edge -- .

Column 7, line 21, after "sets", insert -- of wires -- .

Column 8, line 45, "strip" should be -- shape -- .

Signed and Sealed this

Twenty-first Day of January, 1992

*Attest:*

HARRY F. MANBECK, JR.

*Attesting Officer*

*Commissioner of Patents and Trademarks*